US005384582A

United States Patent [19]

Keith et al.

[11] Patent Number: 5,384,582

[45] Date of Patent: Jan. 24, 1995

[54] CONVERSION OF IMAGE DATA FROM SUBSAMPLED FORMAT TO CLUT FORMAT

[75] Inventors: Michael Keith, Beaverton; Brian Nickerson, Aloha, both of Oreg.

[73] Assignee: Intel Corporation, Hillsboro, Oreg.

[21] Appl. No.: 78,935

[22] Filed: Jun. 16, 1993

[51] Int. Cl.[6] ..... G09G 5/06

[52] U.S. Cl. ..... 345/199; 345/155; 345/149

[58] Field of Search ..... 358/500, 518, 523, 530, 358/457; 345/199, 149, 155

[56] References Cited

U.S. PATENT DOCUMENTS 5,003,299 3/1991 Batson et al. ..... 345/199
5,068,644 11/1991 Batson et al. ..... 345/199
5,124,688 6/1992 Rumball ..... 345/199

*Primary Examiner*—Scott A. Rogers

*Attorney, Agent, or Firm*—Carl Silverman; William H. Murray; Steve Mendelsohn

[57] ABSTRACT

A method, apparatus, and system for generating an image from subsampled, three-component image data. First and second components of the image data are processed to generate a dither index to a dither lookup table. The third component of the image data is dithered. CLUT index data is then generated using the dither data from the dither lookup table and the dithered third-component data. The CLUT index data may then be used to generate the image. In a preferred embodiment, a 14-bit dither index to a 16K dither lookup table is generated from the U and V components of a (4×4) block of YUV9 data. The Y components are dithered and then processed with the appropriate dither lookup table data to generate 16 CLUT index values for the (4×4) block. The dithering and processing is preferably performed on a row-by-row basis in a pseudo-SIMD fashion.

50 Claims, 2 Drawing Sheets

(VIDEO SYSTEM)

FIG. 2 (VIDEO SYSTEM)
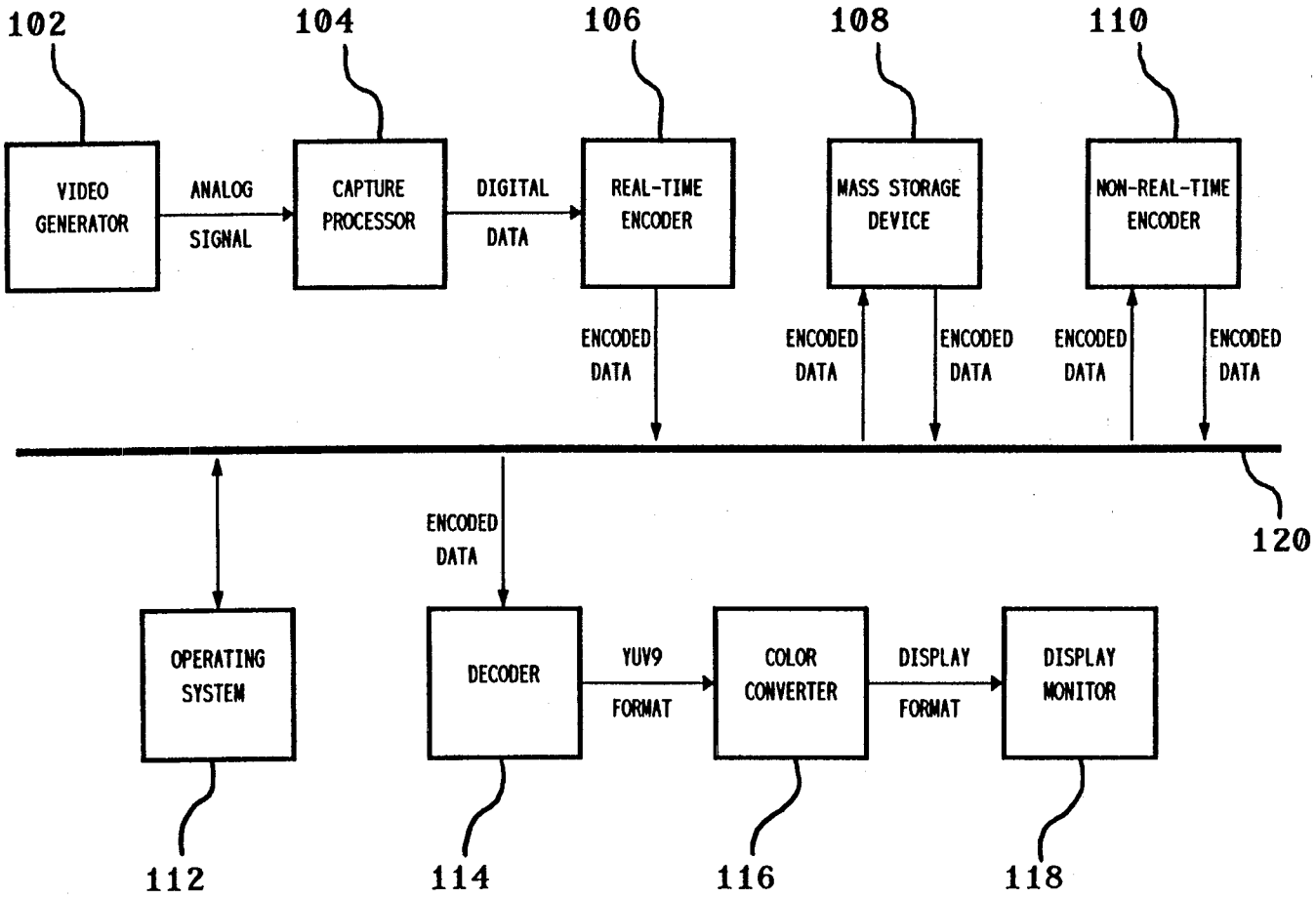

CONVERSION OF IMAGE DATA FROM SUBSAMPLED FORMAT TO CLUT FORMAT

BACKGROUND OF THE INVENTION

1. Field of the Invention

The present invention relates to methods, apparatuses, and systems for processing digital image signals, and, in particular, to methods, apparatuses, and systems for converting image data representing the digital image signals from subsampled three-component format to color lookup table (CLUT) format.

2. Description of the Related Art

Conventional systems for displaying video in a PC environment are limited, in part, by the processing capabilities of the PC processors. These limitations include low video frame rates and small video window sizes for display of video images. Such limitations result in low video quality. As a result, some conventional systems for playing video in a PC environment require additional hardware that is designed to process video data at the rates needed to provide acceptable video quality.

It is, therefore, desirable to provide a playback video system for displaying high-quality, full-motion digital video images on a graphics display monitor in a personal computer (PC) environment that does not require any additional hardware. Such a playback video system is preferably capable of performing decoding, conversion, and display functions to support playback mode. In playback mode, the playback video system accesses encoded video data from a mass storage device, decodes the data into a subsampled three-component video format, converts the subsampled data to color lookup table (CLUT) format, and displays the CLUT data on a display monitor.

It is also desirable to provide a compression video system for generating the encoded video data that will be decoded and displayed by the playback video system. Such a compression video system is preferably capable of performing capture, encoding, decoding, conversion, and display functions to support both a compression mode and the playback mode. In compression mode, the compression video system captures and encodes video images generated by a video generator, such as a video camera, VCR, or laser disc player. The encoded video data may then be stored to a mass storage device, such as a hard drive or, ultimately, a CD-ROM. At the same time, the encoded video data may also be decoded, converted, and displayed on a display monitor to monitor the compression-mode processing.

It is accordingly an object of this invention to overcome the disadvantages and drawbacks of the conventional art and to provide a playback video system for displaying high-quality, full-motion video images in a PC environment.

It is a further object of this invention to provide a compression video system for generating the encoded video data to be decoded, converted, and displayed by the playback video system.

It is a particular object of the present invention to provide efficient conversion of image data from subsampled three-component format to CLUT format for display on a display monitor.

Further objects and advantages of this invention will become apparent from the detailed description of a preferred embodiment which follows.

SUMMARY OF THE INVENTION

The present invention comprises a method and apparatus for generating an image. Subsampled three-component image data corresponding to the image is received. A first component and a second component of the subsampled three-component image data are processed to generate a dither index to a dither lookup table. The dither lookup table contains first-and-second-component dither data corresponding to dithered first-component and second-component data. Data corresponding to a third component of the subsampled three-component image data is dithered. The first-and-second-component dither data is accessed in accordance with the dither lookup table and the dither index. Color lookup table (CLUT) index data corresponding to the image is generated in accordance with the first-and-second-component dither data and the dithered third-component data, where the image is generated in accordance with the CLUT index data.

The invention comprises also a system for generating an image. In a preferred embodiment, the system has means for generating subsampled three-component image data corresponding to the image. The system also has conversion means, comprising means for processing a first component and a second component of the subsampled three-component image data to generate a dither index to a dither lookup table, where the dither lookup table contains first-and-second-component dither data corresponding to dithered first-component and second-component data. The conversion means also has means for dithering data corresponding to a third component of the subsampled three-component image data. In addition, the conversion means has means for accessing the first-and-second-component dither data in accordance with the dither lookup table and the dither index. The conversion means further has means for generating CLUT index data corresponding to the image in accordance with the first-and-second-component dither data and the dithered third-component data. In addition, the system has means for generating the image in accordance with the CLUT index data.

In an alternative preferred embodiment, the system for generating an image has a decoder for generating subsampled three-component image data corresponding to the image. The system also has a color converter for processing a first component and a second component of the subsampled three-component image data to generate a dither index to a dither lookup table, where the dither lookup table contains first-and-second-component dither data corresponding to dithered first-component and second-component data. The color converter also dithers data corresponding to a third component of the subsampled three-component image data. In addition, the color converter accesses the first-and-second-component dither data in accordance with the dither lookup table and the dither index. The color converter further generates CLUT index data corresponding to the image in accordance with the first-and-second-component dither data and the dithered third-component data. In addition, the system has a display monitor for displaying the image in accordance with the CLUT index data.

BRIEF DESCRIPTION OF THE DRAWINGS

Other objects, features, and advantages of the present invention will become more fully apparent from the following detailed description of a preferred embodiment, the appended claims, and the accompanying drawings in which:

FIG. 2 is a block diagram of a video system for displaying video images in a PC environment, according to a preferred embodiment of the present invention.

DESCRIPTION OF PREFERRED EMBODIMENT(S)

Description of Video System

Figure 1:
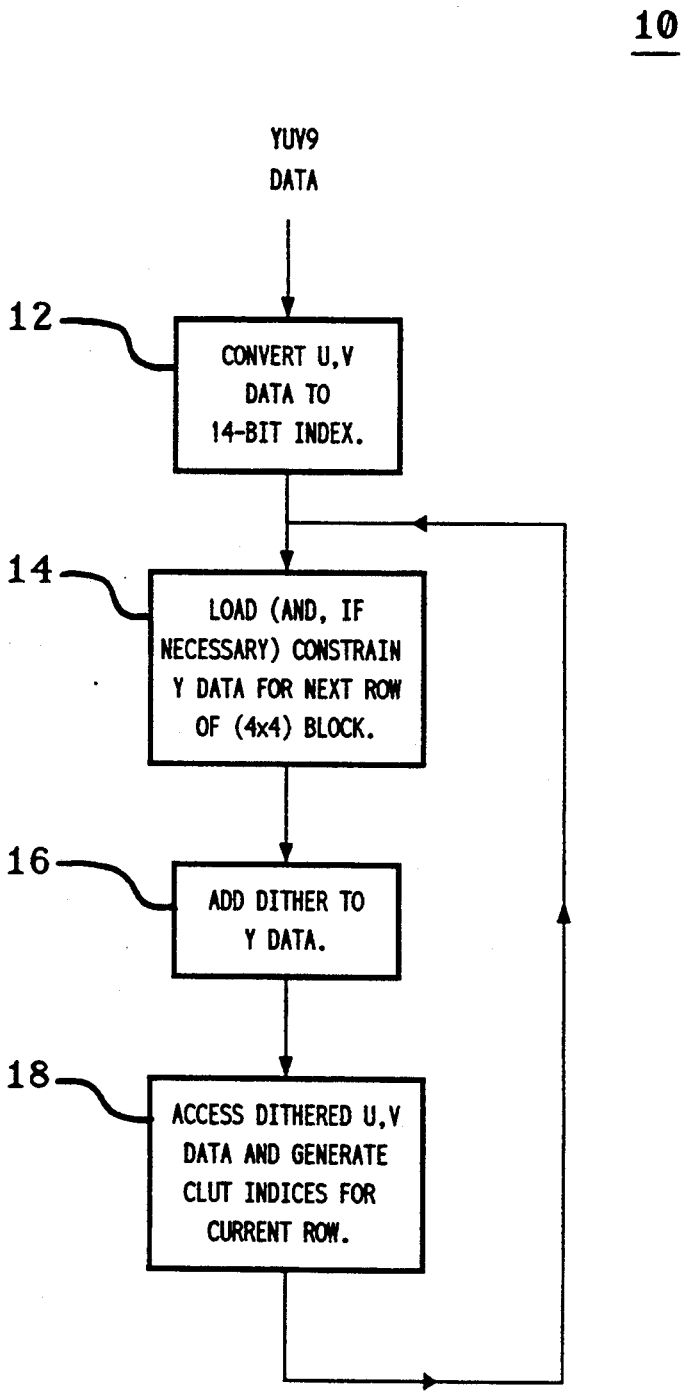
FIG. 1 is a process flow diagram of the YUV9-to-CLUT8 conversion method for converting decoded, scaled image data from subsampled YUV9 format to full-resolution CLUT8 format, as implemented by the color converter of the video system of FIG. 2.

Referring to FIG. 2, there is shown a block diagram of a video system 100 for displaying video images in a PC environment, according to a preferred embodiment of the present invention. Video system 100 is capable of performing in the compression and playback modes. The operations of video system 100 are controlled by operating system 112 which communicates with the other processing engines of video system 100 via system bus 120.

When video system 100 operates in compression mode, video generator 102 of video system 100 generates analog video signals and transmits those signals to capture processor 104. Capture processor 104 decodes (i.e., separates) the analog video signal into three linear components (one luminance component Y and two chrominance components U and V), digitizes each component, and scales the digitized data. Scaling of the digitized data preferably includes subsampling the U and V data to generate digitized video data in subsampled YUV9 format. Those skilled in the art will understand that YUV9 data has one U-component value and one V-component value for every (4×4) block of Y-component values.

Real-time encoder 106 encodes (i.e., compresses) each component of the captured (i.e., unencoded or uncompressed) YUV9 data separately and transmits the encoded data via system bus 120 for storage to mass storage device 108.

The encoded data may then be optionally further encoded by non-real-time encoder 110. If such further encoding is selected, then non-real-time encoder 110 accesses the encoded data stored in mass storage device 108, encodes the data further, and transmits the further encoded video data back to mass storage device 108. The output of non-real-time encoder 110 is further encoded video data.

Video system 100 also provides optional monitoring of the compression-mode processing. If such monitoring is selected, then, in addition to being stored to mass storage device 108, the encoded data (generated by either real-time encoder 106 or non-real-time encoder 110) is decoded (i.e., decompressed) back to YUV9 format (and scaled for display) by decoder 114. Color converter 116 then converts the decoded, scaled YUV9 data to a display format selected for displaying the video images on display monitor 118. For the present invention, the display format is preferably selected to be CLUT8 format, although alternative embodiments of the present invention may support additional or alternative CLUT display formats.

When video system 100 operates in the playback mode, decoder 114 accesses encoded video data stored in mass storage device 108 and decodes and scales the encoded data back to decoded YUV9 format. Color converter 116 then converts the decoded, scaled YUV9 data to a selected CLUT display format for display on display monitor 118.

In a preferred embodiment, operating system 112 is a multi-media operating system, such as, but not limited to, Microsoft® Video for Windows or Apple® QuickTime, running on a personal computer with a general purpose processor, such as, but not limited to, an Intel® x86 or Motorola® microprocessor. An Intel®x86 processor may be an Intel® 386, 486, or Pentium™ processor. Video generator 102 may be any source of analog video signals, such as a video camera, VCR, or laser disc player. Capture processor 104 and real-time encoder 106 are preferably implemented by a video co-processor such as an Intel® i750 encoding engine on an Intel® Smart Video Board. Non-real-time encoder 110 is preferably implemented in software running on the general purpose processor.

Mass storage device 108 may be any suitable device for storing digital data, such as a hard drive or a CD-ROM. Those skilled in the art will understand that video system 100 may have more than one mass storage device 108. For example, video system 100 may have a hard drive for receiving encoded data generated during compression mode and a CD-ROM for storing other encoded data for playback mode.

Decoder 114 and color converter 116 are preferably implemented in software running on the general purpose processor. Display monitor 118 may be any suitable device for displaying video images and is preferably a graphics monitor such as a VGA monitor.

Those skilled in the art will understand that each of the functional processors of video system 100 depicted in FIG. 2 may be implemented by any other suitable hardware/software processing engine.

Description of Conversion from YUV9 to CLUT8 Format

Typical PC-display systems support the use of an 8-bit color lookup table (CLUT) that may contain up to 256 different colors for displaying pixels on display monitor 118 of video system 100 of FIG. 2. Each CLUT color corresponds to a triplet of YUV components.

In a preferred embodiment, video system 100 utilizes CLUT index values 12 through 243 to define a 232-color CLUT. The CLUT is based on the 15 evenly spaced Y-component values from 8 to 120 and the selection of 16 different pairs of U,V components. Each of the 16 U,V pairs corresponds to a different base index value. Table I presents the CLUT index values corresponding to the 240 possible combinations of 15 Y-component values and 16 U,V pairs.

TABLE I

| U, V | Base | HQV CLUT Index Values | | | | | | | | | | | | | | |
|---|---|---|---|---|---|---|---|---|---|---|---|---|---|---|---|---|
| | | Y Value | | | | | | | | | | | | | | |
| Pair | Index | 8 | 16 | 24 | 32 | 40 | 48 | 56 | 64 | 72 | 80 | 88 | 96 | 104 | 112 | 120 |
| 1 | 0 | 12 | 20 | 28 | 36 | 44 | 52 | 60 | 68 | 76 | 84 | 92 | 100 | 108 | 116 | 124 |
| 2 | 1 | 13 | 21 | 29 | 37 | 45 | 53 | 61 | 69 | 77 | 85 | 93 | 101 | 109 | 117 | 125 |
| 3 | 2 | 14 | 22 | 30 | 38 | 46 | 54 | 62 | 70 | 78 | 86 | 94 | 102 | 110 | 118 | 126 |

TABLE I-continued

| U, V Pair | Base Index | HQV CLUT Index Values Y Value 8 | 16 | 24 | 32 | 40 | 48 | 56 | 64 | 72 | 80 | 88 | 96 | 104 | 112 | 120 |
|---|---|---|---|---|---|---|---|---|---|---|---|---|---|---|---|---|
| 4 | 3 | 15 | 23 | 31 | 39 | 47 | 55 | 63 | 71 | 79 | 87 | 95 | 103 | 111 | 119 | 127 |
| 5 | 4 | 16 | 24 | 32 | 40 | 48 | 56 | 64 | 72 | 80 | 88 | 96 | 104 | 112 | 120 | 128 |
| 6 | 5 | 17 | 25 | 33 | 41 | 49 | 57 | 65 | 73 | 81 | 89 | 97 | 105 | 113 | 121 | 129 |
| 7 | 6 | 18 | 26 | 34 | 42 | 50 | 58 | 66 | 74 | 82 | 90 | 98 | 106 | 114 | 122 | 130 |
| 8 | 7 | 19 | 27 | 35 | 43 | 51 | 59 | 67 | 75 | 83 | 91 | 99 | 107 | 115 | 123 | 131 |
| 9 | 120 | 236 | 228 | 220 | 212 | 204 | 196 | 188 | 180 | 172 | 164 | 156 | 148 | 140 | 132 | 124 |
| 10 | 121 | 237 | 229 | 221 | 213 | 205 | 197 | 189 | 181 | 173 | 165 | 157 | 149 | 141 | 133 | 125 |
| 11 | 122 | 238 | 230 | 222 | 214 | 206 | 198 | 190 | 182 | 174 | 166 | 158 | 150 | 142 | 134 | 126 |
| 12 | 123 | 239 | 231 | 223 | 215 | 207 | 199 | 191 | 183 | 175 | 167 | 159 | 151 | 143 | 135 | 127 |
| 13 | 124 | 240 | 232 | 224 | 216 | 208 | 200 | 192 | 184 | 176 | 168 | 160 | 152 | 144 | 136 | 128 |
| 14 | 125 | 241 | 233 | 225 | 217 | 209 | 201 | 193 | 185 | 177 | 169 | 161 | 153 | 145 | 137 | 129 |
| 15 | 126 | 242 | 234 | 226 | 218 | 210 | 202 | 194 | 186 | 178 | 170 | 162 | 154 | 146 | 138 | 130 |
| 16 | 127 | 243 | 235 | 227 | 219 | 211 | 203 | 195 | 187 | 179 | 171 | 163 | 155 | 147 | 139 | 131 |

Note that the CLUT index values for U,V pairs 1 through 8 are identical to the CLUT index values for U,V pairs 9 through 16, respectively, for Y-component value 120. Thus, the 240 different combinations of U,V pairs and Y-component values map to only 232 different CLUT index values, thereby allowing use of preferred embodiments of the present invention even when up to 24 colors in the CLUT palette are reserved for use by the operating system. Those skilled in the art will understand that the U,V pairs are preferably selected such that there is little visual difference between, for example, U,V pair 1 and U,V pair 9 at Y-component value 120.

Referring now to FIG. 1, there is shown a process flow diagram of a YUV9-to-CLUT8 conversion method 10 for converting decoded, scaled video data from subsampled YUV9 format to full-resolution CLUT8 format, as implemented by color converter 116 of video system 100 of FIG. 2, according to a preferred embodiment of the present invention. Under conversion method 10, color converter 116 converts the 16 Y-, one U-, and one V-component values for each (4×4) block of each video frame to 16 CLUT index values. Conversion method 10 preferably applies pseudo-SIMD (single-instruction, multiple-data) processing techniques, whereby values corresponding to multiple pixels are loaded into single registers and processed in parallel to simulate SIMD processing on a non-SIMD processor.

Under conversion method 10, color converter 116 preferably dithers all three components of the YUV data according to the following dither matrix:

| | | | |
|---|---|---|---|
| 1 | 7 | 3 | 5 |
| 3 | 5 | 1 | 7 |
| 7 | 1 | 5 | 3 |
| 5 | 3 | 7 | 1 |

Those skilled in the art will understand that the noise of this preferred dither matrix is oriented towards the diagonal frequencies and therefore produces a visually pleasing result. It will also be understood that alternative embodiments of video system 100 may employ alternative dithering matrices and dithering schemes.

According to step 12 of conversion method 10, the 8-bit U-component value u and 8-bit V-component value v corresponding to a (4×4) block of Y-component data are converted to a 14-bit index, according to the following set of instructions:

```
bx=TruncateU[u]

bx  =TruncateV[v]
```

where bx is the lower two bytes of 32-bit register ebx and "  =" is the "bitwise inclusive OR assign" operator. Note that register ebx is preferably initialized to 0. TruncateU is a 256-byte lookup table that maps the 8-bit value u according to the following equation:

$$\text{TruncateU}[u]=\text{clamp0_31}((u+2-64)>>2)<<4$$

and TruncateV is a 256-byte lookup table that maps the 8-bit value v according to the following equation:

$$\text{TruncateV}[v]=\text{clamp0_31}((v+2-64)>>2)<<9$$

where function "clamp0_31" clamps a value to the limits 0 through 31, ">>" is the "bitwise right shift" operator, and "<<" is the "bitwise left shift" operator.

Those skilled in the art will understand that, after step 12 is implemented, register ebx contains a 14-bit value, where bits 0–3 are 0, bits 4–8 correspond to the U-component value u, and bits 9–13 correspond to the V-component value v. Color converter 116 uses this 14-bit value as an index to a 16K lookup table (called DitherTable). For each of the $2^{10}$ or 1024 possible values of the 14-bit index, DitherTable contains sixteen 8-bit values corresponding to the results of upsampling the U- and V-component values to full (4×4) resolution and dithering the upsampled U,V data according to the dither matrix (described earlier in this specification). Each 8-bit value in DitherTable is one of the base indices listed in Table I. DitherTable is arranged such that four consecutive 8-bit entries correspond to the base indices for dithered U,V data for one row of a (4×4) block.

In a preferred embodiment of the present invention, the Y components of the YUV9 format data received by color converter 116 may be either 8-bit values from (0–255) or 7-bit values constrained to represent values from (8–120). If the Y-component data are unconstrained 8-bit values, then step 14 of conversion method 10 constrains the Y-component data. According to step 14, the Y-component data are constrained by converting to 7 bits and clamping to values between 8 and 120 inclusive. Step 14 is preferably implemented for each row of a (4×4) block according to the following set of instructions:

```
cl=3rd Y-component value

al=ClampTable[ecx]

cl=4rd Y-component value
```

```
ah=ClampTable[ecx] eax<<=16

cl=1st Y-component value

al=ClampTable[ecx]

cl=2nd Y-component value

ah=ClampTable[ecx]
```

where cl is the lowest byte of 32-bit register ecx, al and ah are the lowest and second lowest bytes of 32-bit register eax, ClampTable is a table that maps 8-bit values corresponding to (0–255) to 7-bit values constrained to (8–120), and "eax<<=16" shifts the value in register eax 16 bits to the left. Those skilled in the art will understand that after step 14 is implemented, four constrained 7-bit values corresponding to one row of a (4×4) block of Y-component data are stored in register eax, with the 1st constrained Y-component value in the lowest byte and the 4th constrained Y-component value in the highest byte of register eax.

If the Y-component data is already constrained, then step 14 may be implemented by reading the four pixels for a row of a (4×4) block from memory into register eax with a single instruction.

After step 14 is implemented, step 16 adds the appropriate dither values, in a pseudo-SIMD fashion, to the Y-component data stored in register eax. When the current row is the first row of a (4×4) block, step 16 implements the following instruction:

```
eax+=01070305H,
```

where "+=" is the "add assign" operator and H indicates that the preceding value is in hexadecimal format. When the current row is the second row of a (4×4) block, step 16 implements the following instruction:

```
eax+=03050107H.
```

When the current row is the third row of a (4×4) block, step 16 implements the following instruction:

```
eax+=07010503H.
```

When the current row is the fourth row of a (4×4) block, step 16 implements the following instruction:

```
eax+=05030701H.
```

Those skilled in the art will understand that step 16 is equivalent to adding the appropriate row of the dither matrix to the row of Y-component data stored in register eax.

For step 18, color converter 116 then accesses DitherTable using the 14-bit index value generated in step 12 and generates the CLUT indices for one row of a (4×4) block in pseudo-SIMD fashion by implementing the following set of instructions:

```
eax  =DitherTable[ebx+i]

eax &=78787878H

eax+=DitherTable[ebx+i]

eax+=04040404H
```

where "  =" is the "bitwise exclusive OR assign" operator, "&=" is the "bitwise AND assign" operator, and i has a value of 0 for the first row of (4×4) block, 4 for the second row, 8 for the third row, and 12 for the fourth row. After step 18 is implemented, register eax contains four 8-bit CLUT indices corresponding to one row of a (4×4) block, where the lowest byte in register eax corresponds to the left-most pixel in the row. These 8-bit CLUT indices may then be written to memory from register eax for transmission to display monitor 118 of FIG. 2.

Those skilled in the art will understand that, for each Y component in a (4×4) block, steps 16 and 18 combine to implement the following equation:

```
CLUT index=(((Y+Ydither)     BaseIndex) &
  78H)+BaseIndex+4
```

where Ydither is the appropriate dither value for the Y component, BaseIndex is the base index of Table I corresponding to the U,V data, "  " is the "exclusive OR" operator, and "&" is the "bitwise AND" operator. It will also be understood by those skilled in the art that, for U,V base indices with values (0–7), the CLUT index may be computed according to the following equation:

```
CLUT index=Y'+BaseIndex+4,
```

where Y' is one of the 15 Y-component values of Table I. Similarly, for U,V base indices with values (120–127), the CLUT index may be computed according to the following equation:

```
CLUT index=120−Y'+BaseIndex+4.
```

Steps 14, 16, and 18 are repeated for each row of the (4×4) block. Conversion method 10 may then be repeated to convert another (4×4) block of YUV9 data. This sequence proceeds until the entire frame of YUV9 data is converted. The sequence is then repeated for the next YUV9 data frame.

Those skilled in the art will understand that alternative embodiments of the present invention may be based on multi-media operating systems other than Microsoft® Video for Windows and Apple® QuickTime and/or in PC environments based on processors other than Intel® x86 or Motorola® microprocessors. It will also be understood by those skilled in the art that the present invention may be used to convert data corresponding to images other than video images.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A method for generating an image, comprising the steps of:

(a) receiving subsampled three-component image data corresponding to said image;

(b) processing a first component and a second component of said subsampled three-component image data to generate a dither index to a dither lookup table, wherein said dither lookup table contains first-and-second-component dither data corresponding to dithered first-component and second-component data;

(c) dithering data corresponding to a third component of said subsampled three-component image data;

(d) accessing said first-and-second-component dither data in accordance with said dither lookup table and said dither index; and (e) generating CLUT index data corresponding to said image in accordance with said first-and-second-component dither data of step (d) and said dithered third-component data of step (c), wherein said image is generated in accordance with said CLUT index data.

2. The method of claim 1, wherein:

said subsampled three-component image data is in YUV9 format;

said first component is the U component of said YUV9 format data;

said second component is the V component of said YUV9 format data;

said third component is the Y component of said YUV9 format data;

3. The method of claim 2, wherein said dither index comprises a 14-bit index to a 16K dither table.

4. The method of claim 2, wherein step (c) comprises the step of dithering said Y-component data in a pseudo-SIMD fashion.

5. The method of claim 2, wherein step (e) comprises the step of generating said CLUT index data in a pseudo-SIMD fashion.

6. The method of claim 2, wherein said Y component is a constrained 7-bit Y component.

7. The method of claim 11, wherein step (a) comprises the steps of:

(1) receiving unconstrained 8-bit Y components; and (2) mapping said unconstrained 8-bit Y components to generate said 7-bit Y components constrained to values from 8 to 120.

8. The method of claim 2, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

9. The method of claim 1, wherein said method is implemented on a general purpose processor.

10. An apparatus for generating an image, comprising:

(a) means for receiving subsampled three-component image data corresponding to said image;

(b) means for processing a first component and a second component of said subsampled three-component image data to generate a dither index to a dither lookup table, wherein said dither lookup table contains first-and-second-component dither data corresponding to dithered first-component and second-component data;

(c) means for dithering data corresponding to a third component of said subsampled three-component image data;

(d) means for accessing said first-and-second-component dither data in accordance with said dither lookup table and said dither index; and (e) means for generating CLUT index data corresponding to said image in accordance with said first-and-second-component dither data of means (d) and said dithered third-component data of means (c), wherein said image is generated in accordance with said CLUT index data.

11. The apparatus of claim 10, wherein:

said subsampled three-component image data is in YUV9 format;

said first component is the U component of said YUV9 format data;

said second component is the V component of said YUV9 format data;

said third component is the Y component of said YUV9 format data;

12. The apparatus of claim 11, wherein said dither index comprises a 14-bit index to a 16K dither table.

13. The apparatus of claim 11, wherein means (c) comprises means for dithering said Y-component data in a pseudo-SIMD fashion.

14. The apparatus of claim 11, wherein means (e) comprises means for generating said CLUT index data in a pseudo-SIMD fashion.

15. The apparatus of claim 11, wherein said Y component is a constrained 7-bit Y component.

16. The apparatus of claim 15, wherein means (a) comprises:

(1) means for receiving unconstrained 8-bit Y components; and (2) means for mapping said unconstrained 8-bit Y components to generate said 7-bit Y components constrained to values from 8 to 120.

17. The apparatus of claim 11, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

18. The apparatus of claim 10, wherein said apparatus comprises a general purpose processor.

19. A system for generating an image, comprising:

(a) means for generating subsampled three-component image data corresponding to said image;

(b) conversion means comprising:

(1) means for processing a first component and a second component of said subsampled three-component image data to generate a dither index to a dither lookup table, wherein said dither lookup table contains first-and-second-component dither data corresponding to dithered first-component and second-component data;

(2) means for dithering data corresponding to a third component of said subsampled three-component image data;

(3) means for accessing said first-and-second-component dither data in accordance with said dither lookup table and said dither index; and (4) means for generating CLUT index data corresponding to said image in accordance with said first-and-second-component dither data of means (b)(3) and said dithered third-component data of means (b)(2); and (c) means for generating said image in accordance with said CLUT index data.

20. The system of claim 19, wherein:

said subsampled three-component image data is in YUV9 format;

said first component is the U component of said YUV9 format data;

said second component is the V component of said YUV9 format data;

said third component is the Y component of said YUV9 format data;

21. The system of claim 20, wherein said dither index comprises a 14-bit index to a 16K dither table.

22. The system of claim 20, wherein means (b)(2) comprises means for dithering said Y-component data in a pseudo-SIMD fashion.

23. The system of claim 20, wherein means (b)(4) comprises means for generating said CLUT index data in a pseudo-SIMD fashion.

24. The system of claim 20, wherein said Y component is a constrained 7-bit Y component.

25. The system of claim 24, wherein means (b) further comprises:

(5) means for receiving unconstrained 8-bit Y components from means (a); and (6) means for mapping said unconstrained 8-bit Y components to generate said 7-bit Y components constrained to values from 8 to 120.

26. The system of claim 20, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

27. The system of claim 19, wherein means (a) and means (b) are implemented on a general purpose processor.

28. A system for generating an image, comprising:

(a) a decoder for generating subsampled three-component image data corresponding to said image;

(b) a color converter for:

(1) processing a first component and a second component of said subsampled three-component image data to generate a dither index to a dither lookup table, wherein said dither lookup table contains first-and-second-component dither data corresponding to dithered first-component and second-component data;

(2) for dithering data corresponding to a third component of said subsampled three-component image data;

(3) for accessing said first-and-second-component dither data in accordance with said dither lookup table and said dither index; and (4) for generating CLUT index data corresponding to said image in accordance with said first-and-second-component dither data and said dithered third-component data; and (c) a display monitor for displaying said image in accordance with said CLUT index data.

29. The system of claim 28, wherein:

said subsampled three-component image data is in YUV9 format;

said first component is the U component of said YUV9 format data;

said second component is the V component of said YUV9 format data;

said third component is the Y component of said YUV9 format data;

30. The system of claim 29, wherein said dither index comprises a 14-bit index to a 16K dither table.

31. The system of claim 29, wherein said color converter dithers said Y-component data in a pseudo-SIMD fashion.

32. The system of claim 29, wherein said color converter generates said CLUT index data in a pseudo-SIMD fashion.

33. The system of claim 29, wherein said Y component is a constrained 7-bit Y component.

34. The system of claim 33, wherein said color converter:

(5) receives unconstrained 8-bit Y components from said decoder; and (6) maps said unconstrained 8-bit Y components to generate said 7-bit Y components constrained to values from 8 to 120.

35. The system of claim 29, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

36. The system of claim 28, wherein said decoder and said color converter are implemented on a general purpose processor.

37. The system of claim 28, further comprising:

(d) a mass storage device for storing encoded three-component image data, wherein said decoder decodes said encoded three-component image data to generate said subsampled three-component image data.

38. The system of claim 37, wherein said mass storage device is one of a CD-ROM and a computer hard drive.

39. The system of claim 37, further comprising:

(e) an encoder for generating encoded three-component image data, wherein said decoder decodes said encoded three-component image data to generate said subsampled three-component image data.

40. The system of claim 39, wherein said encoder comprises a video co-processor.

41. The system of claim 39, wherein said encoder is implemented on a general purpose processor.

42. The system of claim 39, further comprising:

(f) an image generator for generating analog image signal corresponding to said image; and (g) a capture processor for converting said analog image signal to unencoded three-component image data, wherein said encoder encodes said unencoded three-component image data to generate said encoded three-component image data.

43. The system of claim 42, wherein:

said image generator is one of a video camera, VCR, and laser disc player; and a capture board comprises said capture processor.

44. A method for generating an image, comprising the steps of:

(a) receiving YUV9 image data corresponding to said image, wherein said YUV9 image data comprises constrained 7-bit Y-component data;

(b) processing the U-component and the V-component of said YUV9 image data to generate a 14-bit dither index to a 16K dither lookup table, wherein said dither lookup table contains UV dither data corresponding to dithered U-component and V-component data;

(c) dithering the Y-component of said YUV9 image data in a pseudo-SIMD fashion;

(d) accessing said UV dither data in accordance with said dither lookup table and said dither index; and (e) generating CLUT index data corresponding to said image in a pseudo-SIMD fashion in accordance with said UV dither data of step (d) and said dithered Y-component data of step (c), wherein said image is generated in accordance with said CLUT index data, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

45. An apparatus for generating an image, comprising:

(a) means for receiving YUV9 image data corresponding to said image, wherein said YUV9 image data comprises constrained 7-bit Y-component data;

(b) means for processing the U-component and the V-component of said YUV9 image data to generate a 14-bit dither index to a 16K dither lookup table, wherein said dither lookup table contains UV dither data corresponding to dithered U-component and V-component data;

(c) means for dithering the Y-component of said YUV9 image data in a pseudo-SIMD fashion;

(d) means for accessing said UV dither data in accordance with said dither lookup table and said dither index; and (e) means for generating CLUT index data corresponding to said image in a pseudo-SIMD fashion in accordance with said UV dither data and said dithered Y-component data, wherein said image is generated in accordance with said CLUT index data, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

46. A system for generating an image, comprising:

(a) means for generating YUV9 image data corresponding to said image, wherein said YUV9 image data comprises constrained 7-bit Y-component data;

(b) conversion means comprising:

(1) means for processing the U-component and the V-component of said YUV9 image data to generate a 14-bit dither index to a 16K dither lookup table, wherein said dither lookup table contains UV dither data corresponding to dithered U-component and V-component data;

(2) means for dithering the Y-component of said YUV9 image data in a pseudo-SIMD fashion;

(3) means for accessing said UV dither data in accordance with said dither lookup table and said dither index; and (4) means for generating CLUT index data corresponding to said image in a pseudo-SIMD fashion in accordance with said UV dither data of means (b)(3) and said dithered Y-component data of means (b)(2); and (c) means for generating said image in accordance with said CLUT index data, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

47. A system for generating an image, comprising:

(a) a decoder for generating YUV9 image data corresponding to said image, wherein said YUV9 image data comprises constrained 7-bit Y-component data;

(b) a color converter for:

(1) processing the U-component and the V-component of said YUV9 image data to generate a 14-bit dither index to a 16K dither lookup table, wherein said dither lookup table contains UV dither data corresponding to dithered U-component and V-component data;

(2) for dithering the Y-component of said YUV9 image data in a pseudo-SIMD fashion;

(3) for accessing said UV dither data in accordance with said dither lookup table and said dither index; and (4) for generating CLUT index data corresponding to said image in a pseudo-SIMD fashion in accordance with said UV dither data and said dithered Y-component data; and (c) a display monitor for displaying said image in accordance with said CLUT index data, wherein said CLUT index data corresponds to a 232-color CLUT based on 15 evenly spaced Y components and 16 UV pairs of U and V components, wherein the CLUT indices for 8 UV pairs are identical to the CLUT indices for the other 8 UV pairs for the greatest Y component.

48. The system of claim 47, wherein said decoder and said color converter are implemented on a general purpose processor.

49. The system of claim 47, further comprising:

(d) an image generator for generating analog image signal corresponding to said image;

(e) a capture processor for converting said analog image signal to unencoded YUV9 image data;

(f) a first encoder for generating encoded image data from said unencoded YUV9 image data;

(g) a second encoder for generating further encoded image data from said encoded image data; and (h) a mass storage device for storing said encoded and said further encoded image data.

50. The system of claim 49, wherein:

said image generator is one of a video camera, VCR, and laser disc player;

a capture board comprises said capture processor and said first encoder, said first encoder comprising a video co-processor;

said second encoder is implemented on a general purpose processor; and said mass storage device is one of a CD-ROM and a computer hard drive.

* * * * *

UNITED STATES PATENT AND TRADEMARK OFFICE

CERTIFICATE OF CORRECTION

PATENT NO. : 5,384,582

DATED : January 24, 1995

INVENTOR(S) : Michael Keith and Brian Nickerson

It is certified that error appears in the above-indentified patent and that said Letters Patent is hereby corrected as shown below:

Column 4, line 47, delete "PC-display" and insert therefor --PC display--.

Column 6, line 19, before "=" insert --|--.

Column 6, line 21, before "=" insert --|--.

Column 7, line 1, delete "eax<<=16".

Column 7, between lines 1 and 2, insert --eax<<=16--.

Column 7, line 62, before "=" insert --^--.

Column 8, line 1, before "=" insert --^--.

Column 8, line 17, delete "Ydither)" and insert therefor --Ydither) ^ --.

Column 8, line 21, after "data,"" insert --^--.

Signed and Sealed this

Thirteenth Day of June, 1995

*Attest:*

*Attesting Officer*

BRUCE LEHMAN

*Commissioner of Patents and Trademarks*